US009245493B2

(12) United States Patent
Kim et al.

(10) Patent No.: US 9,245,493 B2
(45) Date of Patent: Jan. 26, 2016

(54) DEVICES AND METHODS FOR INDICATING ACTIVE FRAME STARTS

(71) Applicant: APPLE INC., Cupertino, CA (US)

(72) Inventors: Taesung Kim, Los Altos, CA (US); Christopher P. Tann, San Jose, CA (US); Sandro H. Pintz, Menlo Park, CA (US)

(73) Assignee: APPLE INC., Cupertino, CA (US)

( * ) Notice: Subject to any disclaimer, the term of this patent is extended or adjusted under 35 U.S.C. 154(b) by 179 days.

(21) Appl. No.: 14/035,039

(22) Filed: Sep. 24, 2013

(65) Prior Publication Data

US 2015/0084973 A1 Mar. 26, 2015

(51) Int. Cl.
*G09G 3/36* (2006.01)
*G09G 5/00* (2006.01)

(52) U.S. Cl.
CPC ..... *G09G 5/006* (2013.01); *G09G 5/001* (2013.01); *G09G 2330/021* (2013.01); *G09G 2360/12* (2013.01); *G09G 2360/18* (2013.01)

(58) Field of Classification Search
CPC ..... G09G 3/3611; G09G 2360/12; G09G 2370/08
See application file for complete search history.

(56) References Cited

U.S. PATENT DOCUMENTS

| | | | | |
|---|---|---|---|---|
| 7,006,115 | B2 | 2/2006 | Janardhanan et al. | |
| 7,580,018 | B2 | 8/2009 | Takeda et al. | |
| 8,179,406 | B2 | 5/2012 | Mori et al. | |
| 2005/0195148 | A1 * | 9/2005 | Iisaka | 345/98 |
| 2009/0273557 | A1 * | 11/2009 | Song et al. | 345/100 |
| 2011/0043551 | A1 | 2/2011 | Kikuta | |
| 2011/0164076 | A1 | 7/2011 | Lee | |

* cited by examiner

*Primary Examiner* — Hau Nguyen
(74) *Attorney, Agent, or Firm* — Fletcher Yoder PC

(57) ABSTRACT

Devices and methods for providing an indication of an active frame start, while reducing a number of line buffers utilized by conventional systems are provided herein. By way of example, an electronic display panel may include a host device (e.g., a processor) that provides an indication of a pending active frame start. The indication may be provided at a predetermined and fixed time/line interval before the active frame start. Next, a timing controller of the display circuitry may generate a vertical start pulse during vertical blanking based upon the indication and the fixed time/line interval. The vertical start pulse may be used to drive multi-clock integrated row driver circuits.

24 Claims, 7 Drawing Sheets

DEVICES AND METHODS FOR INDICATING ACTIVE FRAME STARTS

BACKGROUND

The present disclosure relates generally to electronic displays and, more particularly, to providing an indication of the start of active frame data prior to displaying the active frame on the display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs) and organic light emitting diode (OLED) displays, are commonly used in electronic devices such as televisions, computers, and phones. The electronic displays display images when image data is sent by a timing controller (TCON) to display drivers in the electronic display. Oftentimes, these displays may implement integrated row driver technology for an enhanced narrow bezel design. However, this integrated row driver technology oftentimes consumes large amounts of power due to high-voltage swing clocks used in this technology. Accordingly, to reduce power consumption, multiple clocks may be used to reduce the frequency of the clock signals over multiple clocks. A vertical start pulse is used in this multi-clock approach. The vertical start pulse is provided several lines earlier than the actual frame start, indicating a time when the actual frame start begins. In conventional systems, the vertical start pulse is placed subsequent to the active frame start by using one or more line buffers to delay the active frame data during a lead time expected by the display circuitry (e.g., a fixed amount of time between the vertical start pulse and the start of the active frame). Unfortunately, these line buffers may offer several inefficiencies. For example, the line buffers may occupy a significant amount of die area of display circuitry and may also consume excessive amounts of power.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for providing an indication of an active frame start, while reducing a number of line buffers utilized by conventional systems. By way of example, an electronic display panel may include a host device (e.g., a processor) that provides an indication of a pending active frame start. The indication may be provided at a predetermined and fixed interval before the active frame start. Next, a timing controller of the display circuitry may generate a vertical start pulse during vertical blanking based upon the indication and the fixed interval. The vertical start pulse may be used to drive multi-clock integrated row driver circuits, resulting in timely activation of the active frame data.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements.

The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
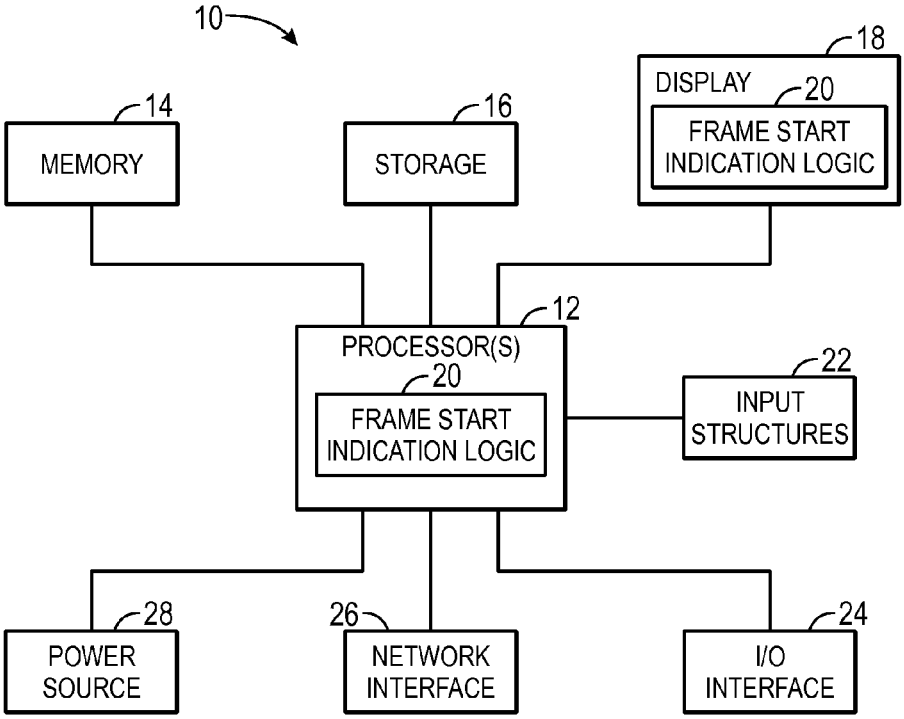
FIG. 1 is a schematic block diagram of an electronic device with a display having active frame start indication logic, in accordance with an embodiment.
Figure 2:
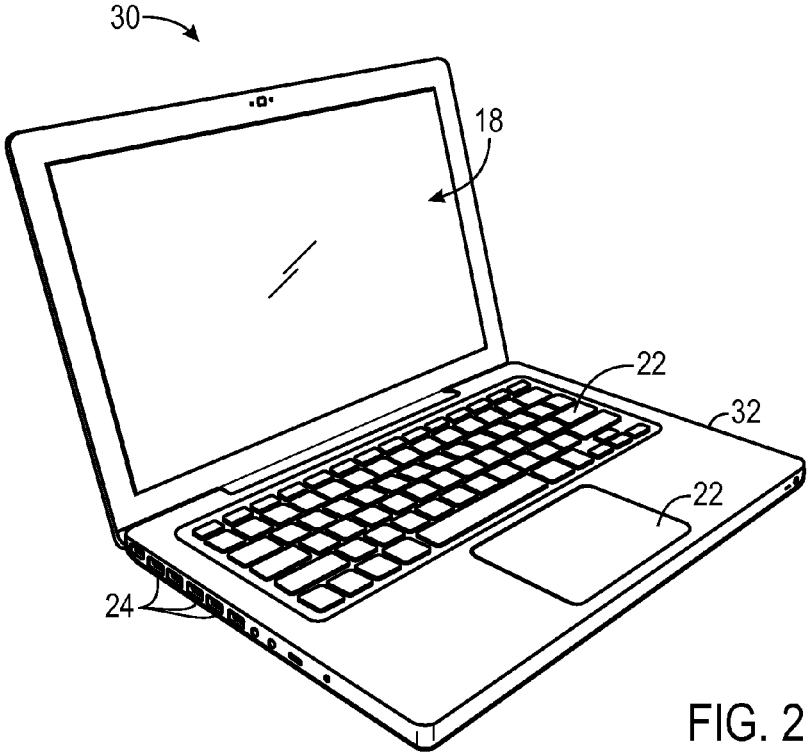
FIG. 2 is a perspective view of a notebook computer representing an embodiment of the electronic device of FIG. 1.
Figure 3:
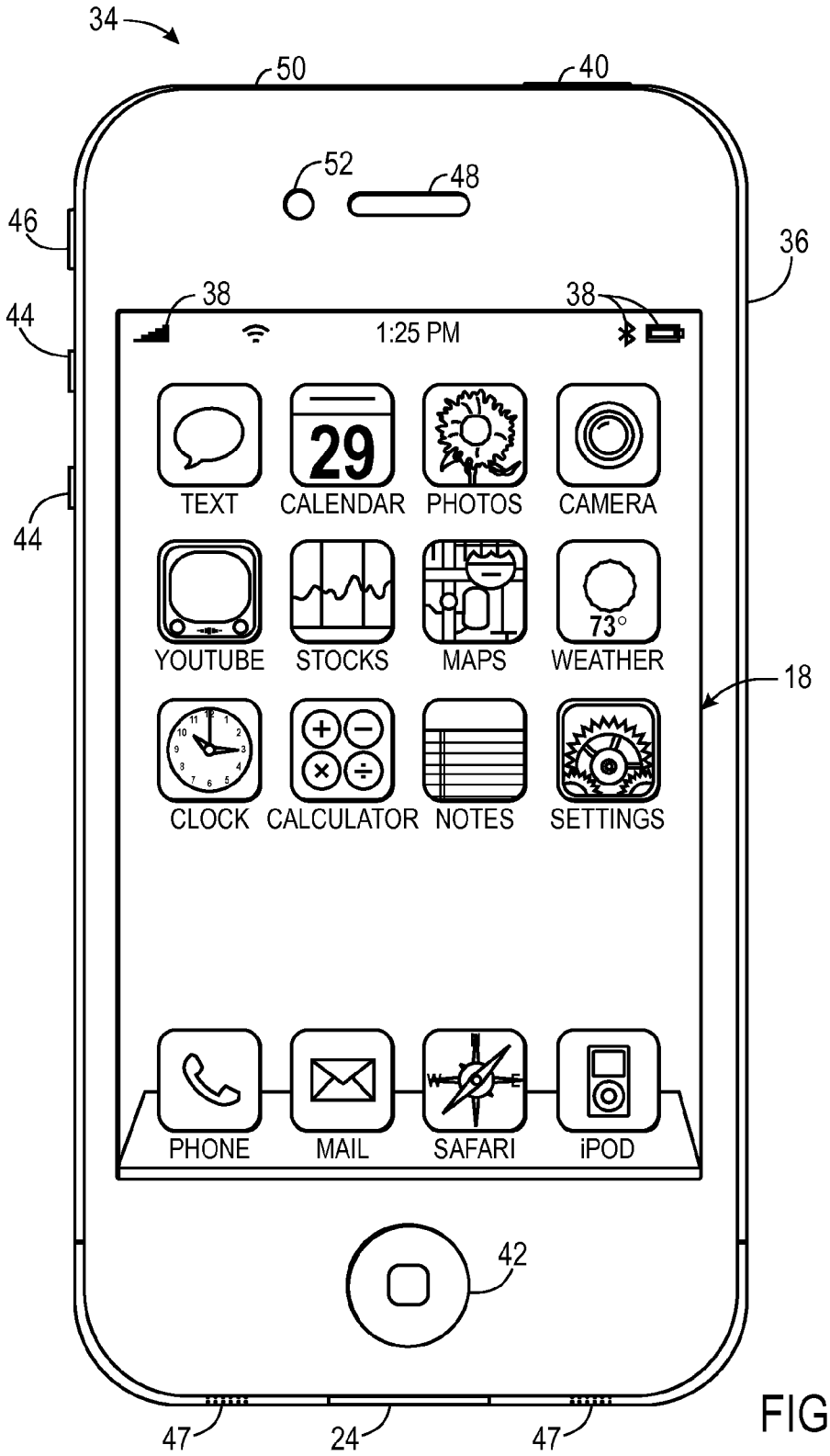
FIG. 3 is a front view of a hand-held device representing another embodiment of the electronic device of FIG. 1.

With the foregoing in mind, a general description of suitable electronic devices that may employ electronic displays having active frame start indication capabilities will be provided below. In particular, FIG. 1 is a block diagram depicting various components that may be present in an electronic device suitable for use with such a display. FIGS. 2 and 3 respectively illustrate perspective and front views of suitable electronic devices, which may be, as illustrated, a notebook computer or a handheld electronic device.

As mentioned briefly above, multi-clock schemes may be introduced in display circuitry to reduce power consumption of a high-voltage swing clock. However, to support these multi-clock schemes, vertical start pulses are oftentimes provided a pre-determined number of lines prior to active frame data (e.g., the active frame start). While this pre-determined number of lines has traditionally been guaranteed by delaying the active frame data via line buffers after a vertical start pulse has been provided, the current approach may use a reference indication during a vertical blanking period (e.g., a time period between active frame display) without delaying the active frame data.

Embodiments of the present disclosure involve identifying and providing an indication representative of a pending active frame start. Specifically, the indication is provided during the vertical blanking period to a timing controller (TCON). The TCON may detect the indication and generate a vertical start pulse to drive integrated row driver circuits to display the active frame data.

Turning first to FIG. 1, an electronic device 10 according to an embodiment of the present disclosure may include, among other things, one or more processor(s) 12, memory 14, nonvolatile storage 16, a display 18, frame start indication logic 20 (which may be logic implemented by the processor 12 and/or circuitry of the display 18), input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to execute instructions to carry out, among other things, the techniques disclosed herein. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable other functions of the electronic device 10.

The display 18 may be a touch-screen liquid crystal display (LCD) or organic light emitting diode (OLED) display, for example, which may enable users to interact with a user interface of the electronic device 10. In some embodiments, the display 18 may be a MultiTouch™ display that can detect multiple touches at once. The display 18 may include circuitry that uses a vertical start pulse a fixed number of lines prior to active frame data to signify start of the active frame. The display 18 and/or a host providing active frame data (e.g., the processor 12) may provide active frame start indication logic 20, such that the active frame data may be provided during the vertical blanking period without delay via line buffers. Accordingly, fewer line buffers may be used by the display circuitry, potentially resulting in less utilized die space in the display 18 circuitry as well as reduced power consumption by the display 18. As mentioned above, the frame start indication logic 20 may be implemented via processor-readable instructions stored on a tangible, non-transitory storage medium and/or implemented via circuitry.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on display 18. The display 18 may include the active frame start indication logic 20 to indicate and process active frame starts without delaying the active frame data via line buffers.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a graphical user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. Further, the display 18 may include the active frame indication logic 20 to indicate and process active frame starts without delaying the active frame data via line buffers.

Figure 4:
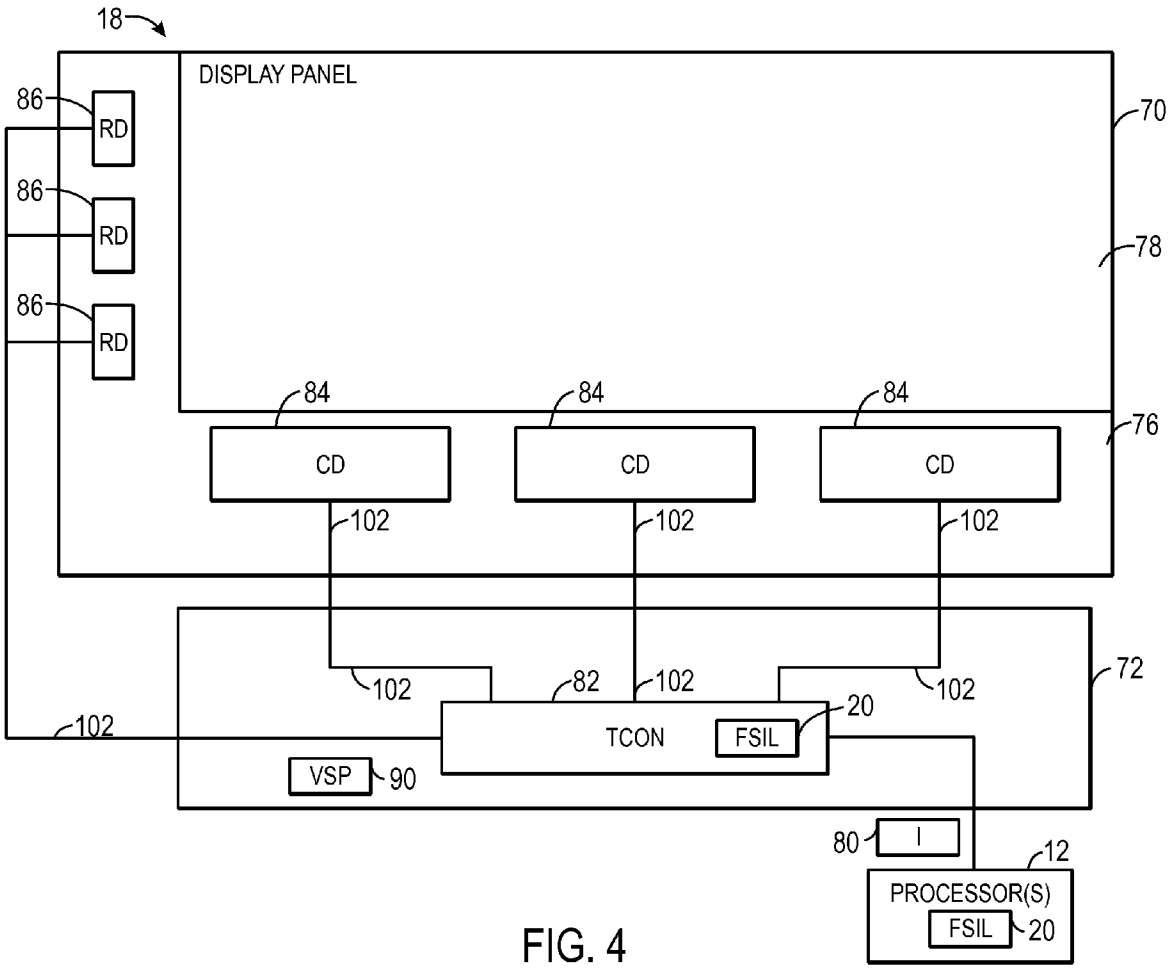
FIG. 4 is a block diagram of the electronic display of the electronic device of FIG. 1, in accordance with an embodiment.

For example, as noted above, the display 18 may generally receive and display image data and may include the active frame start indication logic 20 to provide an early indication of a pending active frame start. Further, the active frame start indication logic 20 may generate vertical start pulses during the vertical blanking period, using the early indication as a timing reference. As will be discussed with reference to FIG. 4, the various internal components of the display 18 may allow the display 18 to receive a vertical start pulse during the vertical blanking period, enabling start of an active frame without delaying provision of the active frame data via line buffers. As shown in FIG. 4, a display panel 70 of the display 18 may be communicably coupled to an electronic display interface 72 via any suitable interconnection. For example, flexible printed circuit (FPC) interconnections may be used to communicably couple the display panel 70 with the electronic display interface 72. The display panel 70 of the display 18 may include an active display area 78 having an array of pixels and display driver circuitry 76 that program the array of pixels.

To display images on active display area 78, a host (e.g., one or more of the processor(s) 12) may provide image data to the electronic display interface 72 via any suitable connector. For example, this connector may be an Embedded Display Port (eDP) connector, an Internal Display Port (iDP) connector, a High-Definition Media Interface (HDMI) or Digital Visual Interface (DVI) connector, and/or a Mobile Industry Processor Interface (MIPI) connector. As will be discussed in greater detail below, in addition to providing image data signals, the processor(s) 12 also may control certain operational parameters of the display 18. Among other things, the processor(s) 12 may provide an indication 80 of a pending active frame start (e.g., prior to sending the active frame data).

During ordinary operation of the display 18, a timing controller (TCON) 82 may receive image data signals from the processor(s) 12. Further, the TCON 82 may receive the indication 80 from the processor(s) 12. The TCON 82 then may transmit a vertical start pulse and the image data signals through the unidirectional data lines 102 to the column drivers (CDs) 84 of the display driver circuitry 76. The column drivers (CDs) 84 may represent data drivers, of which the display 18 may include any suitable number. Though only three are illustrated in the schematic block diagram of FIG. 4, the display 18 may include more or fewer. Each of the column drivers (CDs) 84 may program the image data signals onto a segment of the active display area 78.

Specifically, the column drivers (CDs) 84 may operate in concert with row drivers (RDs) 86. A row driver 86 may activate one row of pixels of the active display area 78 and the column drivers (CDs) 84 may respectively program one segment of the activated row of pixels with the image data. As the row drivers (RDs) 86 activate successive rows of pixels, the column drivers (CDs) 84 may successively program the activated pixels with the image data. As a result, images may be displayed on the active display area 78.

The row drivers (RDs) 86 may activate rows of pixels according to the vertical start pulse 90 provided by the TCON 82 (e.g., via one or more interconnections 102). For example, the vertical start pulse 90 may indicate that active frame data should be displayed in the active display area 78 after a particular interval has passed. Accordingly, the vertical start pulse may be provided to the row drivers 86 at the interval based upon the indicator 80. After receiving the vertical start pulse 90 and the interval passing, the row drivers (RDs) 86 may activate particular rows of pixels. As discussed above, the frame start indication logic 20 may be used to provide the indication 80 to the TCON 82 and may also be used to interpret the indication 80 at the TCON to provide the vertical start pulse 90 to the row drivers (RDs) 86. A more detailed discussion of particular embodiments of the frame start indication logic 20 is provided below.

Figure 5:
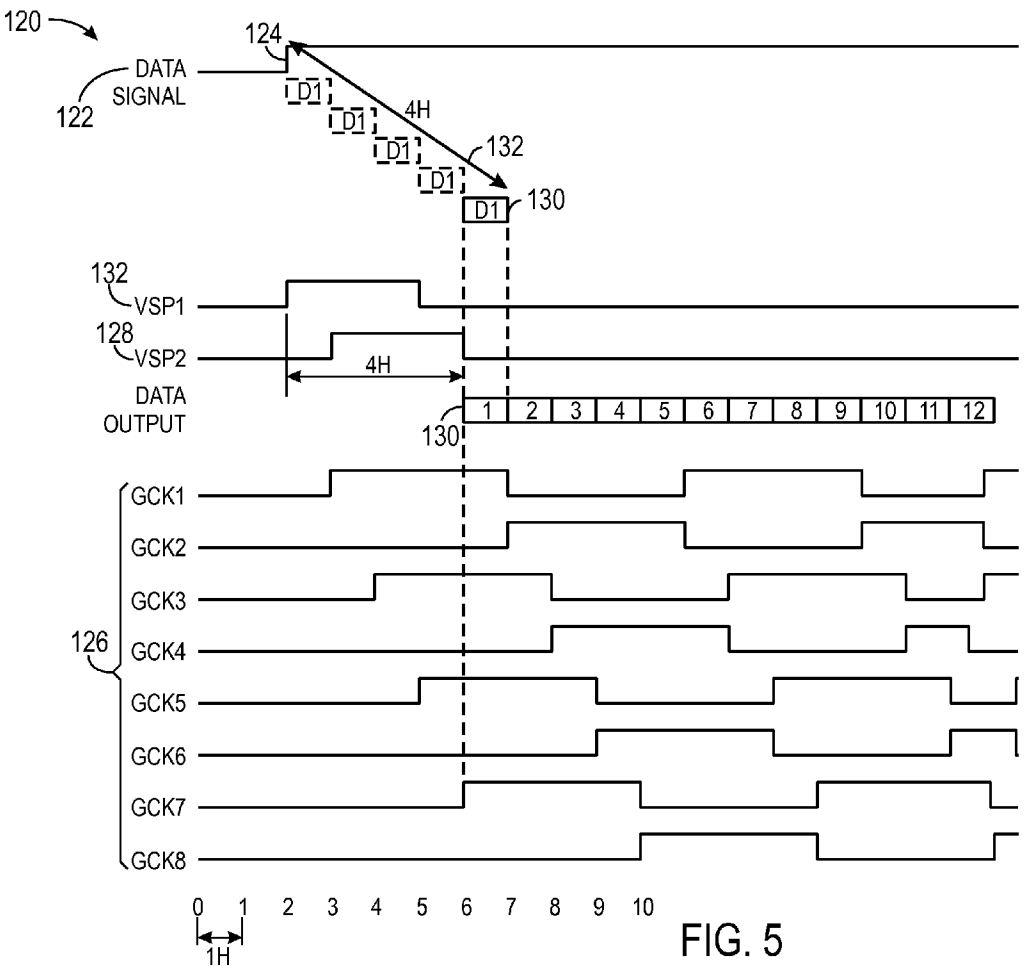
FIG. 5 is an example illustration of a gate-on-array (GOA) display manufacturer's signal timing requirements, in accordance with an embodiment.
Figure 6:
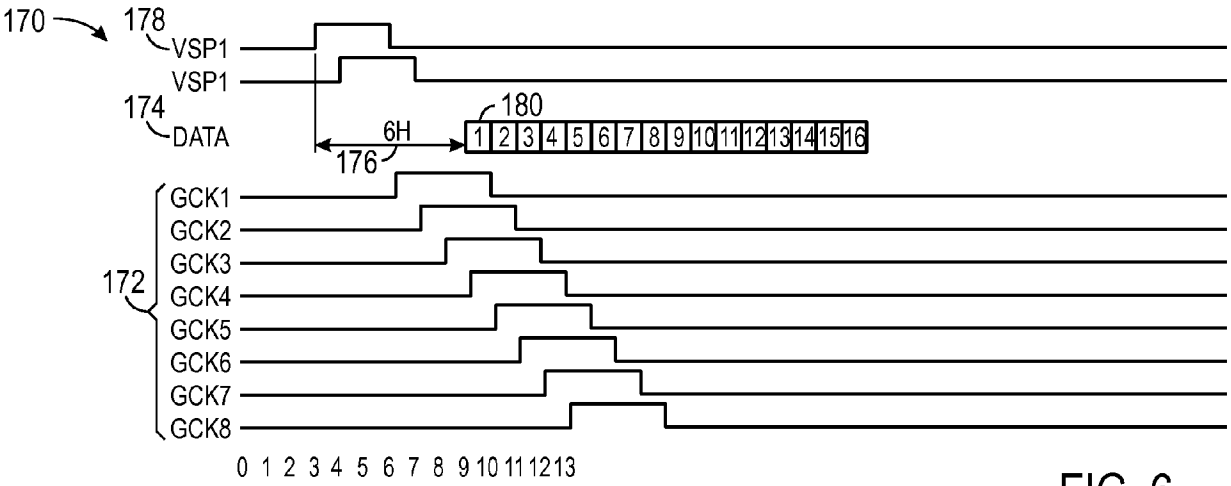
FIG. 6 is an example illustration of a gate-in-panel (GIP) display manufacturer's signal timing requirements, in accordance with an embodiment.

As mentioned above, the display 18 may be configured to receive the vertical start pulse 90 a fixed number of lines prior to the actual start of an active frame. The specific timing configuration may be dictated by a display 18 manufacturer (e.g., the manufacturer of the display driver circuitry 76) and/or a particular display 18 technology that is implemented. For example, FIG. 5 illustrates a timing configuration 120 of a gate-on-array (GOA) display of a first manufacturer and FIG. 6 illustrates a timing configuration 170 of a gate-in-panel (GIP) display of a second manufacturer. These timing configuration illustrations may be used to more clearly demonstrate timing of the provision of the indication 80 and the subsequent vertical start pulse 90.

As illustrated in FIG. 5, the data signal 122 is provided several timing units prior to activation of pixels by the row drivers (RDs). For example, at time interval 2 (e.g., 2 H), the data signal 122 is provided to the column drivers, as indicated by the rising edge 124 of the data signal 122. Under the multi-clock scheme described above, multiple clock signals 126 may be used in parallel to determine whether pixels are activated by the row drivers (RDs). In the provided example, the "gate clock 1," "gate clock 2," "gate clock 3," and "gate clock 4" signals define when the data output 128 is provided to the display 18. For example, a first output line 130 is provided when each of the "gate clock 1," "gate clock 2," "gate clock 3," and "gate clock 4" signals are in an active state. As illustrated, these signals are activated one time interval apart from a subsequent clock signal 126. Accordingly, when the "gate clock 4" signal is activated, each of the requisite gate signals is active and the first output line 130 is provided (e.g., at time interval 6 in the current example).

Adhering to the current timing example, to ensure that the clock signals are properly synchronized with the data signal 122, a vertical start pulse lead time 132 of four time intervals (e.g., 4 H) should be provided. Specifically, the 4 H lead time 132 should reside between activating the vertical start pulse 132 and outputting the first column driver output line 130. As will be discussed in more detail below with regards to FIGS. 7-10, the active frame start indication logic 20 may be useful in generating the vertical start pulse 132 during a vertical blanking period, such that the lead time 132 is met without delaying output of the first column driver output line 130.

FIG. 6 illustrates an alternative timing configuration 170. Similar to the four-clock scheme used in the timing configuration 120, a plurality of gate signals 172 may be used to determine whether data output 174 is provided to the display 18. In the current example, the "gate clock 1," "gate clock 2," "gate clock 3," and "gate clock 4" signals define when the data output 174 is provided to the display 18. When all of these gate signals are active, the column driver output becomes active (e.g., time interval 9 in the current example). To adhere to the current timing configuration 170, a lead time 176 should be provided between activation of the vertical start pulse 178 and the output of the first column driver output line 180. Once again, as will be discussed in more detail below with regards to FIGS. 7-10, the active frame start indication logic 20 may be useful in generating the vertical start pulse 178 during a vertical blanking period, such that the lead time 176 is met without delaying output of the first column driver output line 180.

Figure 7:
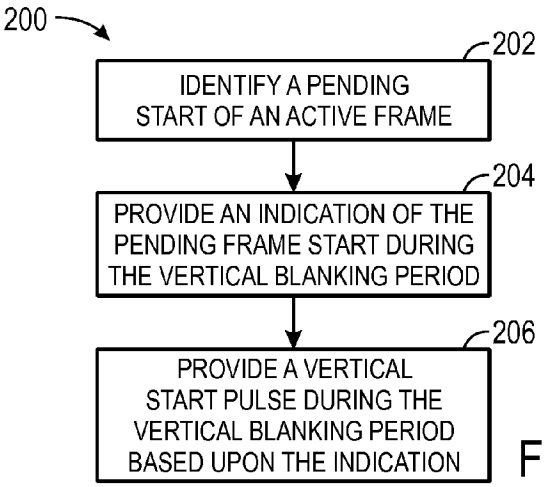
FIG. 7 is a flowchart illustrating a method for providing a vertical start pulse during a vertical blanking period, in accordance with an embodiment.

Turning now to a more detailed discussion of the active frame start indication logic, FIG. 7 is a flowchart illustrating an active frame start indication process 200, in accordance with an embodiment. The process 200 begins at block 202 by identifying a pending start of an active frame of output data (e.g., column driver data to be displayed on the display 18). For example, the host (e.g., processor 12) that provides frame data to the column drivers 84 may also become aware of when the frame data should become active. Next, at block 204, an indication of the pending active frame start is provided during the vertical blanking period of the display 18. For example, the host (e.g., processor 12) may provide the indication to a timing controller 82 of the display 18 circuitry 76. The host may guarantee that the indication is a specific time interval before the start of the active frame (e.g., may provide a guaranteed fixed lead time). Next, at block 206, the timing controller 82 may provide a vertical start pulse during the vertical blanking period, based upon the indication and/or when the indication was received. For example, based upon the fixed lead time agreement between the host (e.g., processor 12) and the timing controller 82, the timing controller 82 may provide a vertical start pulse at a particular lead time prior to the start of the active frame. The particular lead time may be in adherence with the display 18 manufacturer's specification for the display 18, thus ensuring a proper vertical start pulse for a particular display 18 design.

Figure 8:
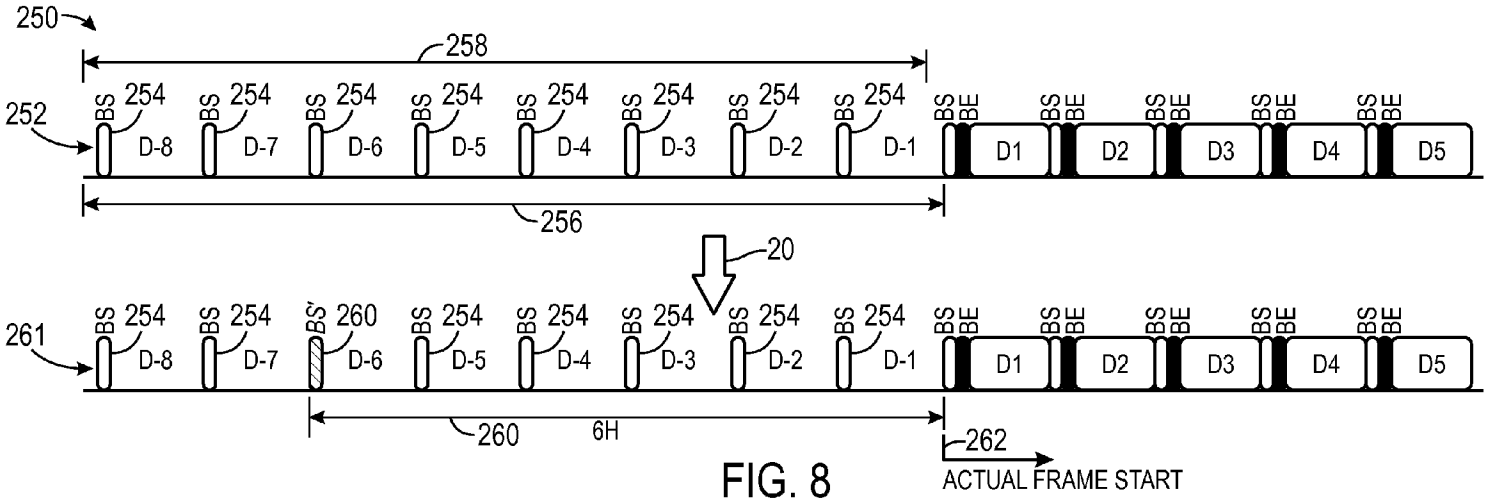
FIG. 8 is a timing diagram illustrating the replacement of a blank start symbol with a special symbol indicating a pending active frame start, in accordance with an embodiment.
Figure 9:
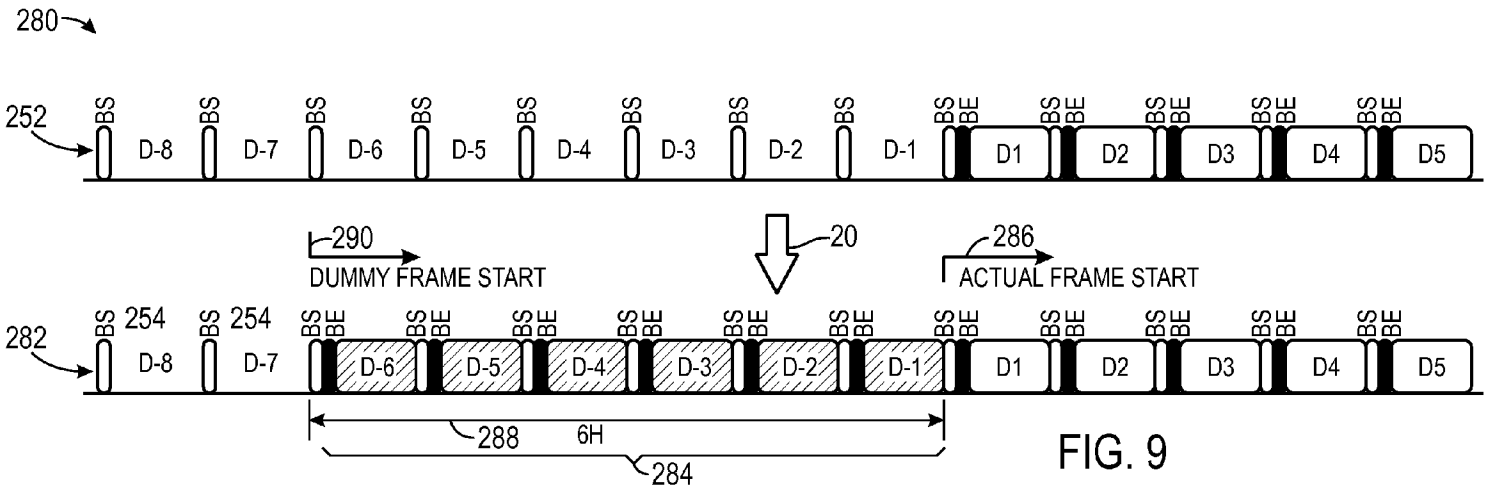
FIG. 9 is a timing diagram illustrating the insertion of fake lines to the head of an active frame start, where the fake lines indicate the pending active frame start, in accordance with an embodiment.
Figure 10:
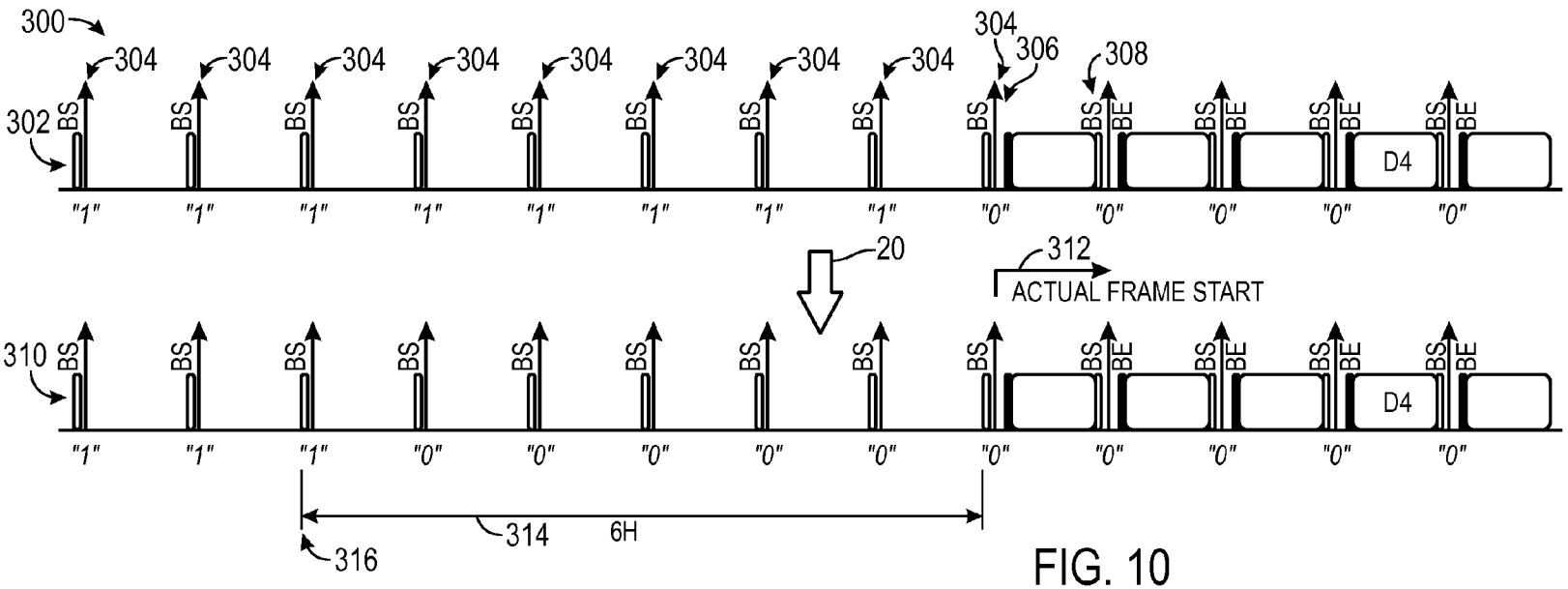
FIG. 10 is a timing diagram illustrating the premature clearing of a vertical blanking identifier bit, indicating a pending active frame start, in accordance with an embodiment.

A variety of methods may exist for providing the early indication of the active frame start without delaying the active frame data. FIGS. 8-10 illustrate examples of particular embodiments of providing the early identification of the active frame start. The embodiments described below are provided as particular examples and are not intended to limit the scope of this specification. FIG. 8 is a timing diagram 250 illustrating the replacement of a blank start symbol with a special symbol indicating a pending active frame start, in accordance with an embodiment. As illustrated by the standard implementation 252, under certain manufacturer specifications, blank start symbols 254 are provided during vertical blanking 256 to define one line length 258. However, using the active frame start indication logic 20, a special symbol 260 that is agreed upon by the host (e.g., processor 12) and the timing controller 82 may be substituted for a particular blank start symbol 254 (e.g., BS'). This substitution may be provided by the host (e.g., processor 12) with a particular lead time 260. This is illustrated in the impacted implementation 261. In the current example the lead time is 6 H, which corresponds to the lead time 176 of FIG. 6. This special symbol 260 (e.g., a 10-bit encoded symbol), may be interpreted as an indication of a pending active frame start 262 by the timing controller 82. Accordingly, the timing controller 82 may interpret that the active frame start will occur at the end of the lead time 260 and may provide a vertical start pulse accordingly using an internal counter from the lead time 260 down to the active frame start time 262. Accordingly, by substituting a particular blank start symbol at a particular lead time, the vertical start pulse may be provided without delaying the active frame data, because the interval between the vertical start pulse and the active frame start may be guaranteed by referencing the indicator 80.

Alternatively, FIG. 9 is a timing diagram 280 illustrating a second method of providing indication data to the display 18 circuitry. Similar to FIG. 8, the standard implementation 252 illustrates a traditional active frame start before implementation of the active frame start indication logic 20. In the embodiment depicted in FIG. 9, the impacted implementation 282 illustrates the insertion of fake lines 284 of active data to the head of an active frame start 286. The fake lines 284 indicate the pending active frame start 286, by spanning the lead time interval 288. Because the fake lines 284 are provided during the vertical blanking period, the fake lines 284 should not be written to the screen, but instead indicate the start of the actual frame. In essence, this approach effectively makes the frame somewhat taller than the original frame. The timing controller 82 may be configured to discard a predefined number of lines (e.g., a number of lines matching the number of fake lines 284) without using additional power consumption. By providing the fake start 290 using the fake lines 284, the timing controller 82 may activate a vertical start pulse between the fake start 290 and the actual frame start 286, in accordance with a manufacturer's specification for the display 18.

FIG. 10 provides an additional active frame start indication embodiment 300. Under certain standard implementations 302, a vertical blanking id (VB-ID) bit 304 is used to distinguish horizontal blanking and vertical blanking Traditionally, this VB-ID bit 304 is set to 1 at the end of the last active lined of a video frame and remains 1 during the vertical blanking period. A source device traditionally clears this bit either immediately prior to the first active line of a video frame (e.g., at point 306) or immediately after the first active line (e.g., at point 308), depending on the manufacturer's specification.

The active frame indication logic 20 may result in an impacted implementation 310 that provides an early indication of an active frame start 312. To provide this indication, the VB-ID bit 304 may be cleared (e.g., set to zero) early during vertical blanking. The early clearing may be a fixed interval (e.g., lead time 314). The timing controller 82 may recognize this early frame start 316, may reset an internal counter and start the vertical start pulse between the early frame start 316 and the actual active frame start 312 and during the vertical blanking period. Once again, the vertical start pulse may be activated based upon a manufacturer's specification.

By providing early notification of an active frame start, the vertical start pulse may be provided at a manufacturer's specified lead time without delaying the start of the active frame data. By removing the dependency of delaying the active frame data, the display circuitry design may be enhanced. For example, fewer line buffers may be utilized. Accordingly, less die space may be used, manufacturing costs may be reduced, and power consumption may be enhanced.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A system, comprising:

display circuitry useful to display active frame data at a particular time; and a host device configured to:

identify a subsequent active frame start representative of the particular time when the active frame data should be displayed; and provide an indication of the subsequent active frame start to the display circuitry at a pre-defined fixed lead time interval, wherein the display circuitry is configured to:

receive the indication of the subsequent active frame start;

determine the pre-determined fixed lead time interval based upon receiving the indication;

determine a specified interval for the display circuitry, the specified interval comprising an interval of time between activating the vertical start pulse and providing the active frame data that is expected by the display circuitry;

calculate a vertical start pulse activation time by calculating the difference between the pre-determined fixed lead time interval and the specified interval;

activate a vertical start pulse indicating the subsequent active frame start at the vertical start pulse activation time; and display the active frame data at the subsequent active frame start, without delaying the active frame data based upon the vertical start pulse.

2. The system of claim 1, comprising:

a timing controller configured to:

receive the indication of the subsequent active frame start from the host device, and provide the vertical start pulse to the display circuitry based upon the received indication.

3. The system of claim 2, wherein the timing controller is configured to provide the vertical start pulse to the display circuitry at an activation time that is a particular interval before the active frame start.

4. The system of claim 3, wherein the timing controller is configured to determine the activation time based upon the pre-defined fixed lead time.

5. The system of claim 1, wherein the display circuitry comprises one or more row drivers that are configured to:

receive the vertical start pulse, and activate based upon the received vertical start pulse.

6. The system of claim 1, wherein the vertical start pulse is received by the display circuitry during a vertical blanking period of the display circuitry.

7. The system of claim 1, wherein the indication is provided by host during a vertical blanking period of the display circuitry.

8. The system of claim 1, wherein the indication comprises a special symbol that is substituted for a blank start symbol, wherein the blank start symbol is a symbol provided according to display circuitry specifications that is used to define one line length.

9. The system of claim 1, wherein the indication comprises a fake frame start that is added to the head of the active frame start, wherein the fake frame start begins a pre-determined fixed number of lines of fake data before the active frame start.

10. The system of claim 9, wherein the display circuitry is configured not to display the pre-determined fixed number of lines of fake data before the active frame start.

11. The system of claim 9, comprising a timing controller configured to provide the vertical start pulse in between the fake frame start and the active frame start.

12. The system of claim 1, wherein the indication comprises a cleared vertical blanking id (VB-ID) bit provided prior to the active frame start, the VB-ID comprising a bit used to distinguish horizontal blanking and vertical blanking according to a standard of the display circuitry.

13. The system of claim 12, wherein the VB-ID bit is cleared by the host a pre-determined fixed interval before the active frame start.

14. The system of claim 13, comprising a timing controller configured to provide the vertical start pulse after the VB-ID bit is cleared, but prior to the active frame start, the VB-ID comprising a bit used to distinguish horizontal blanking and vertical blanking according to a standard of the display circuitry.

15. A machine-implemented method, comprising:

receiving, at display circuitry, an indication of a subsequent active frame start for providing active frame data, wherein the indication is received at a fixed lead time interval of time prior to the subsequent active frame start, that is agreed upon by the timing controller and a host providing the active frame data;

calculating a vertical start pulse activation time by calculating the difference between the fixed lead time interval and a specified interval of the display circuitry, wherein the specified interval is an interval of time between activating the vertical start pulse and providing the active frame data that is expected by the display circuitry;

activating a vertical start pulse at the vertical start pulse activation time, without delaying the active frame data after activating the vertical start pulse.

16. The method of claim 15, wherein providing the indication comprises:

providing a special symbol at a lead time interval prior to the active frame start, wherein the special symbol and the lead time interval are agreed upon by an active frame data host and a timing controller.

17. The method of claim 16, comprising:

activating the vertical start pulse at a time that is the difference between the lead time interval and the specified interval.

18. The method of claim 15, wherein providing the indication comprises:

providing a fake frame start at a lead time interval prior to the active frame start, wherein the lead time interval is agreed upon by an active frame data host and a timing controller.

19. The method of claim 18, comprising:

activating the vertical start pulse at a time that is the difference between the lead time interval and the specified interval.

20. The method of claim 15, wherein providing the indication comprises:

clearing a vertical blanking id (VB-ID) bit at a lead time interval prior to the active frame start, wherein the lead time interval is agreed upon by an active frame data host and a timing controller, the VB-ID comprising a bit used to distinguish horizontal blanking and vertical blanking according to a standard of the display circuitry.

21. The method of claim 20, comprising:

activating the vertical start pulse at a time that is the difference between the lead time interval and the specified interval.

22. A host device of active frame data, configured to:

provide the active frame data to display circuitry;

identify a subsequent active frame start representative of a particular time when the active frame data should be displayed by the display circuitry; and provide an indication of the subsequent active frame start to the display circuitry at a lead time interval, wherein the lead time interval is agreed upon by a timing controller configured to control timing of displaying the active frame data and the host providing the active frame data;

wherein the indication is used by the display circuitry to determine a vertical start pulse activation time for activating a vertical start pulse prior to an active frame start, by;

calculating a difference between the lead time interval and a specified interval, wherein the specified interval is an interval of time between activating the vertical start pulse and providing the active frame data that is expected by the display.

23. The host device of claim 22, comprising a processor of an electronic handheld device, a laptop computer, a workstation computer, or any combination thereof.

24. A timing controller useful for controlling timing of displaying active frame data on a display, configured to:

interpret an indication a subsequent active frame start provided at a fixed lead time interval, wherein the subsequent active frame start represents a time when the active frame data should be displayed on the display and the fixed lead time interval is a fixed interval of time agreed upon by the timing controller and a host providing the active frame data;

calculate a vertical start pulse activation time by calculating the difference between the fixed lead time interval and a specified interval, wherein the specified interval is an interval of time between activating the vertical start pulse and providing the active frame data that is expected by the display; and activate a vertical start pulse at the vertical start pulse activation time, wherein the vertical start pulse activation time is prior to a time where the active frame data is provided.

* * * * *